United States Patent [19]

Sterner

[11] Patent Number: 4,678,363

[45] Date of Patent: Jul. 7, 1987

[54] POTHOLE PATCHER AND ROAD SURFACING DEVICE

[76] Inventor: Carl L. Sterner, 20838 Nord Rd., Bakersfield, Calif. 93312

[21] Appl. No.: 873,387

[22] Filed: Jun. 12, 1986

[51] Int. Cl.[4] ..... E21C 19/05

[52] U.S. Cl. ..... 404/75; 404/92; 404/113

[58] Field of Search ..... 404/75, 92, 101, 108, 404/111, 113, 115

[56] References Cited

U.S. PATENT DOCUMENTS

| | | | |
|---|---|---|---|
| 1,165,331 | 12/1915 | Gray . | |
| 1,487,454 | 3/1924 | Gardiner . | |
| 1,546,185 | 7/1925 | Andersen . | |
| 1,750,104 | 3/1930 | Heltzel . | |
| 1,785,932 | 12/1930 | Brown et al. . | |
| 2,420,410 | 5/1947 | Blankner . | |
| 2,578,080 | 12/1951 | Middlestadt . | |
| 2,669,915 | 2/1954 | McConnaughay | 404/108 |
| 2,830,510 | 4/1958 | Mariani et al. . | |
| 3,217,620 | 11/1965 | Mindrum et al. . | |
| 3,260,176 | 7/1966 | Bowers . | |
| 3,398,662 | 8/1968 | Takata et al. | 404/108 X |
| 3,519,169 | 7/1970 | Holland | 404/111 X |
| 3,625,120 | 12/1971 | Nagy . | |
| 3,712,681 | 1/1973 | Marino et al. . | |
| 3,771,893 | 12/1973 | Miller | 404/101 |
| 4,072,435 | 2/1978 | Lohoctal | 404/75 X |
| 4,124,325 | 11/1978 | Cutler | 404/75 |
| 4,453,856 | 6/1984 | Chiostri et al. | 404/92 X |
| 4,473,320 | 9/1984 | Register | 404/92 X |
| 4,511,284 | 4/1985 | Sterner | 404/108 X |
| 4,534,674 | 8/1985 | Cutler | 404/75 |
| 4,603,999 | 8/1986 | Laditka | 404/113 X |

FOREIGN PATENT DOCUMENTS

| | | |
|---|---|---|
| 841060 | 5/1939 | France . |
| 2094886 | 2/1972 | France . |

*Primary Examiner*—William F. Pate, III
*Assistant Examiner*—Creighton Smith
*Attorney, Agent, or Firm*—Sigalos & Levine

[57] ABSTRACT

An improved moveable road repair and surfacing vehicle of the type having a frame, an aggregate material hopper mounted on a frame, a container on the vehicle for binder material such as asphalt, conveyor means associated with the hopper for carrying aggregate material, a discharge chute associated with the conveyor means for receiving aggregate material carried thereon and directing material downwardly, a discharge outlet on the chute for dispensing the aggregate material therefrom for deposit on a roadway surface, and means for spraying binder material on the dispensed aggregate material. The improved apparatus for applying asphalt coated aggregate to the roadway surface includes a hollow tube rotatably mounted within and extending below the outlet of the aggregate discharge chute, at least one projection mounted on the periphery of the hollow tube for premixing the aggregate material moving downwardly in the discharge chute, means attached to the hollow tube adjacent the bottom thereof for causing the aggregate material to swirl as it drops downwardly to the roadway surface for the discharge outlet, and means attached to the vehicle adjacent the discharge outlet for spraying binder material on the swirling aggregate material after it leaves the discharge outlet but before it reaches the roadway surface.

18 Claims, 4 Drawing Figures

13
34
30
16
22
82
80
78
72
74
88
64
40
48
26
44
76
56
50
58
70
90
46
52
42
86
62
60
20
66
54
68
37
38
24
36
32
84

13
74
68
72
64
46
44
20
42
76
88
56
54
40
48
50
58
36
90
22
52
92
37
60
70
62
24
28
18
38
86
15
16
78
66
72
84

POTHOLE PATCHER AND ROAD SURFACING DEVICE

BACKGROUND OF THE INVENTION

The present invention relates to a road repair and surfacing vehicle of the type which transports road repair and surfacing material to a site to be repaired or surfaced and applies the material to effect the repair or surfacing.

Devices are known for repairing holes in streets and highways commonly known as "potholes". Absent a complete repaving of the street or highway, these potholes are "patched" by filling the pothole with a combination of aggregate material such as gravel and a bitumen, where the bitumen is an asphalt or an asphalt emulsion. Devices for making such repairs are known and generally include a portable vehicle, generally self propelled, which carries a hopper containing aggregate material that has been premixed with a bitumen binder such asphalt or an emulsified asphalt binder. The premixed material is conveyed from the hopper by a screw conveyor to the location for application to the pothole.

In such devices, the premixing of the aggregate and binder material requires that the combined material be heated in order to maintain a sufficient state of fluidity for application to the pothole. However, such heating is not readily accomplished and requires an extensive application of heat to maintain a sufficient fluidity of the material during transport from the hopper to the site of its application. Additionally, the application of the premixed material is difficult due to its tendency to lump together before application to the pothole.

In applicant's U.S. Pat. No. 4,511,284, issued Apr. 16, 1985, applicant disclosed an improved repair vehicle in which cold aggregate material was imparted a swirling motion as it passed down a material discharge chute and then was sprayed with a binding material such as hot asphalt or a cold emulsified asphalt. Because the material is swirling and tumbling, the asphalt binder has a tendency to completely coat the aggregate material and, when a fast setting binder is used, the coated aggregate material binds together immediately as it fills the pothole or forms the roadway surface. Thus there is a great advantage over the prior art in that the aggregate material does not have to be premixed with the binder material and then maintained at a high temperature in order to keep a sufficient state of fluidity for application to the roadbed.

However, while the device disclosed in U.S. Pat. No. 4,511,284 functions effectively as set forth therein, it requires a great deal of power to generate sufficient air pressure to cause the aggregate material to swirl or tumble so that when the binder material is sprayed thereon, it coats the entire surface of each particle of aggregate material.

The present invention overcomes the difficulties of the prior art by providing a movable road repair and surfacing vehicle which again utilizes a cold aggregate material and an asphalt binder which can be sprayed on the aggregate material as it is deposited on the roadway surface. However, in the present invention a hollow shaft is rotatably mounted within the aggregate discharge chute and has near the bottom thereof, a projection in the form of a truncated cone attached symmetrically about the outer periphery of the rotating hollow tube adjacent to but above the lower end of the rotating tube with the large flared end of the cone downwardly and flaring outwardly and having a plurality of raised projections on the outer surface thereof for striking aggregate particles falling through the aggregate discharge chute and imparting to them a swirling outwardly flaring motion. In order to cause better adherence of the asphalt binding material to the aggregate particles, a spray of water mist is applied to the swirling aggregate particles from both above and below and then the hot asphalt binding material is sprayed thereon. The water that is sprayed from below the swirling aggregate particles is obtained from the hollow shaft rotatably mounted within the aggregate discharge chute. In addition, the asphalt binding material passes through a hollow ring surrounding and adjacent the lower end of the discharge chute to spray the tumbling, swirling particles as they are impacted by the truncated cone projection attached to the lower end of the rotating hollow shaft. In addition, a second hopper is utilized on the vehicle to carry any additive such as flyash, cement or the like, which is to be mixed with the dry aggregate in the first hopper. This will allow the use of cement to patch potholes in concrete or form a concrete roadbed. By utilizing a device of the proper size and construction, an entire roadway surface can be deposited as well as potholes patched.

Thus it is an object of the present invention to provide a road surfacing and repair vehicle having an aggregate material discharge chute in which is placed a hollow rotating tube which has on the lower end thereof a truncated cone with projections thereon to mechanically impart a swirling motion to the aggregate material leaving the discharge chute.

It is also an object of the present invention to spray a water mist on the swirling aggregate from above before applying the asphalt to cause better binding of the asphalt to the aggregate material by virtue of the capillary action of the water.

It is another object of the present invention to spray a water mist on the swirling aggregate material from below the falling material before applying the asphalt to obtain complete coverage of the aggregate with the water mist.

It is still another object of the present invention to provide a second hopper for additives or agents which are to be premixed with the aggregate material.

It is yet a further object of the present invention to provide a premixing device in the hollow discharge chute for premixing the aggregate material and any additive from the second hopper.

It is yet another object of the present invention to use a hollow ring surrounding the lower end of the aggregate material discharge chute to distribute asphalt on and coat the swirling aggregate particles.

It is still another object of the present invention to spray a water mist on top of the aggregate material by means of a hollow ring interposed between the asphalt binder hollow ring and the aggregate material discharge chute.

It is also an object of the present invention to spray a water mist on the aggregate material from below the falling material through a nozzle on the lower end of the rotating hollow tube in the center of the aggregate material discharge tube with water supplied through the rotating hollow tube.

SUMMARY OF THE INVENTION

Thus the present invention relates to an improved movable road repair and servicing vehicle of the type having a frame, an aggregate material hopper mounted on the frame, a binder material container on said vehicle, conveyor means associated with the hopper for carrying said aggregate material, means for driving the conveyor means, a discharge chute associated with the conveyor means for receiving the aggregate material carried thereon and directing the material downwardly, and a discharge outlet on the chute for dispensing the aggregate material therefrom for deposit on a roadway surface, and means for spraying asphalt on said dispensed aggregate material, the improved apparatus for applying asphalt coated aggregate to the roadway surface comprising a hollow shaft rotatably mounted within and extending below said outlet of said aggregate discharge chute, at least one projection mounted on the periphery of said hollow shaft for premixing said aggregate material moving downwardly in said discharge chute, means attached to said hollow shaft adjacent the bottom thereof for causing said aggregate material to swirl and flare outwardly as it drops downwardly to said roadway surface, and means attached to said vehicle adjacent to said discharge outlet for spraying said binder material on said swirling aggregate material after it leaves said discharge outlet but before it reaches said roadway surface.

It is also an object of the present invention to provide an improved method of repairing and surfacing a road with a vehicle of the type having a frame, mounting an aggregate material hopper on said frame, providing a binder material container on said vehicle, associating conveyor means with said hopper for carrying said aggregate material, and associating a discharge chute with said conveyor means for receiving said aggregate material carried thereon and directing said material downwardly, and dispensing said aggregate material from a discharge outlet on said chute for deposit on a roadbed to be repaired, the improved method comprising the steps of rotatably mounting a hollow shaft within and extending below said outlet of said aggregate discharge chute, mounting at least one projection on the periphery of said hollow shaft within said chute for premixing said aggregate material moving downwardly in said discharge chute, attaching means to said hollow shaft adjacent to the bottom thereof for causing said aggregate material to swirl and flare outwardly as it drops downwardly to said roadbed from said discharge outlet, and spraying said binder material on said swirling aggregate material after it leaves said discharge outlet but before it reaches said roadbed.

DESCRIPTION OF THE DRAWINGS

These and other objects of the present invention will be disclosed in conjunction with the accompanying drawings in which like numerals represent like components and in which.

DETAILED DESCRIPTION OF THE DRAWINGS

Figure 1:
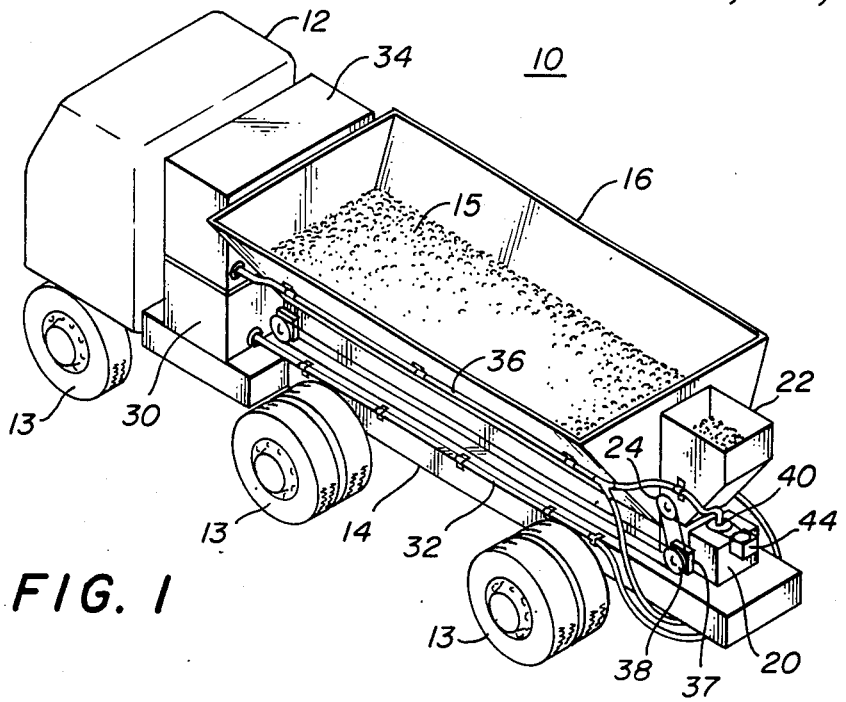
FIG. 1 is an isometric view of an embodiment of the road surfacing and repair device of the present invention.

Referring now to FIG. 1 there is shown a road surfacing and repair vehicle generally designated by the numeral 10 which is shown in this case to be self propelled. This is not necessary however, and is shown for purposes of discussion only. The vehicle could obviously be drawn by another powered vehicle. In FIG. 1, behind a cab 12 is placed a hopper 16 containing aggregate material 15 such as gravel or the like which is cold and uncoated with any binding material. As will be shown in conjunction with FIG. 3 a conveyor or other material moving device 18 is utilized to move the aggregate material from hopper 16 to a discharge chute 20 where the aggregate material 15 drops downwardly toward the roadpath as will be discussed in more detail in relation to FIGS. 2 and 3. An additional hopper 22 is located to the rear of and adjacent hopper 16. Hopper 22 may contain any additive 28 which may be required to mix with the aggregate material 15 to perform a particular function such as flyash, cement or the like. A gear 24 is utilized to turn an agitating device 26 (See FIG. 3) of any well known type in hopper 22 to cause the additive material 28 to fall on the aggregate material 15 which is being carried out of hopper 16 by the conveying means 18. Gear 24 will be driven in a well known manner as explained hereinafter with reference to FIG. 3. Also in any convenient location such as to the front of hopper 16 is a tank 30 which has a binder material such as asphalt therein heated in a well known manner to maintain it in the liquid state or a cold emulsion such as asphalt, vinyl, acrylic, or the like. A hose 32 couples the binder material to the rear of the vehicle for use in spraying on the discharge aggregate material 15 as will be disclosed hereafter with reference to FIGS. 2 and 3. In addition, a water tank 34 is placed in a convenient location on the vehicle such as above the asphalt tank 30 and has a hose 36 which couples the water to the rear of the vehicle for spraying on the aggregate material 15 prior to its being coated with the binder material from tank 30.

Conveyor 18 is driven in any well known manner by a power source 37 such as a motor which drives gear 38. Part of the water in hose 36 is coupled to the top 40 of a hollow rotating tube 42 which is located inside the hollow discharge chute 20. Motor 44 rotates hollow tube 42 in any well known manner such as coupled gears 46 and 48 as shown particularly in FIG. 3.

Figure 2:
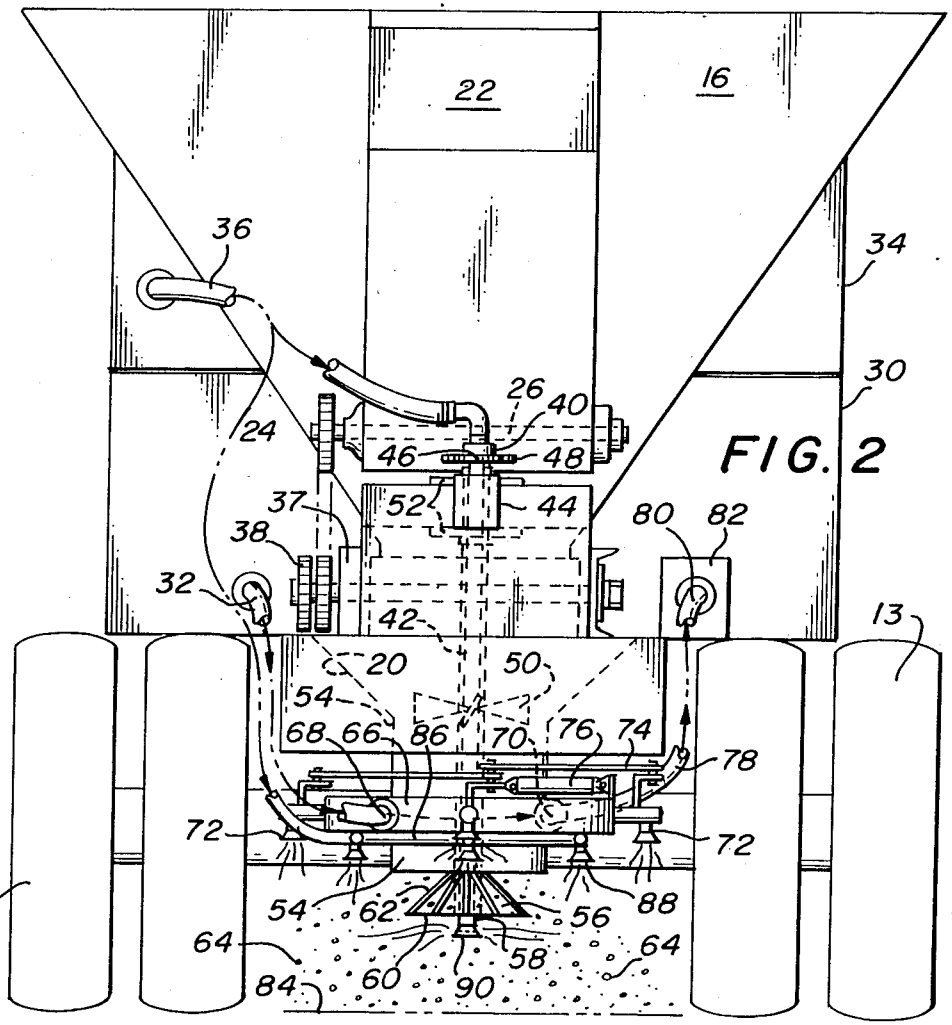
FIG. 2 is a rear view of the aggregate dispensing portion of the road surfacing device of the present invention.

Referring now to FIG. 2 which is a rear view of the road surfacing and repair apparatus, it will be seen that as the aggregate material 15 from hopper 16 and the additive material 28 from hopper 22 are deposited by the conveyor belt 18 in discharge chute 20, it encounters projections or blades 50 on rotating hollow tube 42 which is rotatably mounted within discharge chute 20. Hollow rotating tube 42 is securely mounted in bearings 52 for rotation thereof by motor 44 through gears 46 and 48. As hollow tube 42 rotates, it spins the projections or vanes 50 which premix the aggregate material from hopper 16 with the additive material from hopper 22.

As the mixed aggregate material and additive material continue down discharge chute 20 to the discharge outlet 54 it encounters a projection 56 which may be of various forms and, for example, may be in the form of a truncated cone attached symmetrically about the outer periphery of the rotating hollow tube 42 adjacent to but above the lower end 58 of the rotating tube 42 and below the lower end of discharge outlet 54. The large flared end 60 of the cone 56 extends downwardly and flares outwardly with the lower end of lower end 58 of hollow tube 42 extending below the large flared end 60 of cone 56. A plurality of raised projections 62 are formed on the outer surface of the truncated cone 56 for striking aggregate particles 64 imparting to them a swirling outwardly flaring movement as shown.

In addition, the binder material from tank 30 in hose 32 is coupled to a hollow circular ring 66 which surrounds the discharge outlet 54 and is mounted above but adjacent the truncated cone 56. The hollow ring 66 has an inlet orifice 68 and an outlet orifice 70. In addition, a plurality of spray nozzles 72 extend substantially downwardly from said ring 66 about the circumference thereof. A mechanical coupling 74 is operated by a pneumatic cylinder 76 in any well known manner to simultaneously open and close all of the discharge nozzles 72 as will be explained in more detail with relation to FIG. 4. A return hose 78 couples the binder material back to orifice 80 in tank 30. Orifice 80 is formed in relation to a valve 82 which may be opened or closed as necessary. When the valve 82 is opened and all of the discharge nozzles are off, the binder material simply flows from tank 30 through hose 32, through hollow circular ring 66 and out orifice 70 in hose 78 back through orifice 80 into tank 30. When it is desired to spray the asphalt on the aggregate material, the mechanical coupling 74 is actuated by cylinder 76 to open all of the valves 72 and, simultaneously, valve 82 is closed in any well known manner so that the binder material cannot return to tank 30. Thus pressure is built up in ring 66 and the binder material is forced out the nozzles 72 to spray the aggregate material 64.

Thus it has been found that the inverted truncated cone 56 with ribs or fingers 62 thereon impart a swirling outward motion to the aggregate materials 64 and the additive material in tank 22 which is mixed therewith and causes them to spin or swirl so that as asphalt is sprayed from nozzle 72 the particles are entirely covered before they strike the roadbed 84.

It has been found that by spraying the aggregate material 64 with a water mist prior to the binder material being sprayed thereon, that the capillary action of the water tends to cause the asphalt to adhere more tightly to the aggregate material. Thus water from tank 34 is coupled from hose 36 to a second circular ring 86 having a plurality of nozzles 88 thereon which spray a water mist on the falling and swirling aggregate particles 64. It will be noted that the water ring 86 is mounted between said asphalt spraying hollow ring 66 and the rotatable hollow shaft 42. This enables the water to be sprayed as a mist on the particles 64 prior to their being sprayed by the asphalt from nozzles 72.

It will also be noted that water hose 36 is coupled to the top 40 of the hollow rotating tube 42 so that water enters the interior of the hollow tube 42. At the bottom of hollow tube 42 is a spray nozzle 90 which conveys water outwardly to spray a water mist on the underside of the rotating and swirling particles thereby completely coating them with water. It will be noted that the spray nozzle 90 is mounted below the large end 60 of truncated cone 62. This allows the water mist to be sprayed totally underneath the falling, swirling aggregate material 64.

Figure 3:
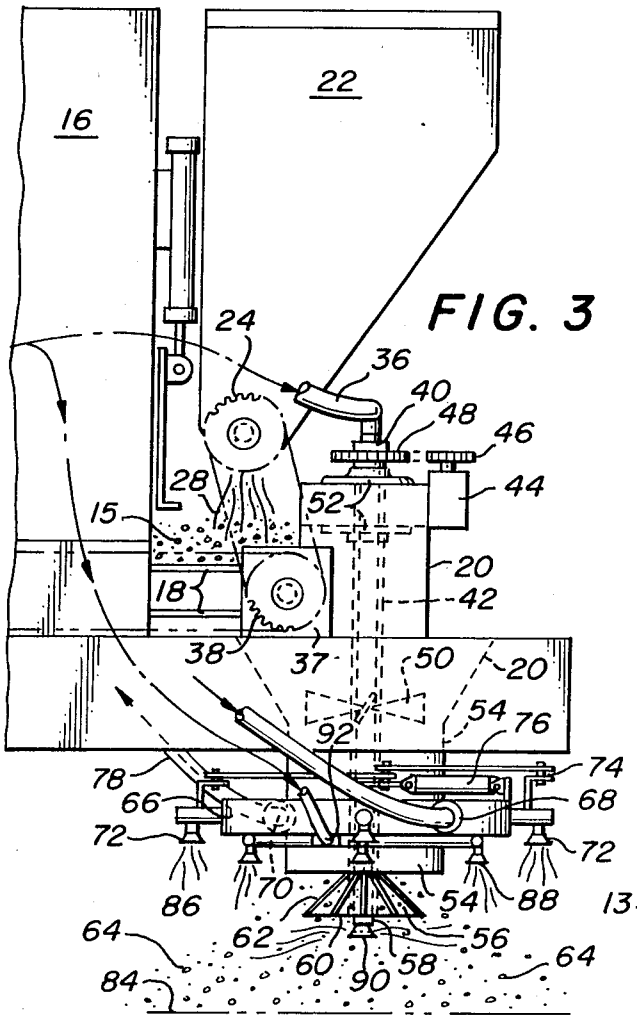
FIG. 3 is a partial side view of the aggregate dispensing portion of the road repair and surfacing vehicle of the present invention.

FIG. 3 is a side view of the aggregate material dispensing portion of the device illustrating the carrying of the aggregate material 15 and the additive material 28 by conveyor belt 18 into hollow discharge chute 20. Also, it can be seen in FIG. 3 that the hollow rotating tube 42 has the projections or vanes 50 thereon for premixing the aggregate material 15 and the additive material 28 as it falls into the discharge outlet 54. In addition, it will be noted that the truncated cone 56 has the large end 60 downward and has projections or ribs 62 on the external surface thereof to impart a swirling motion to the aggregate material since cone 56 is rotating with hollow tube 42. Further it can be seen in FIG. 3 that the spray nozzle 90 on the lower end of hollow rotating tube 58 extends below the lower end 60 of truncated cone 56 in order to spray a water mist on the underside of the aggregate material particles 64 that are being swirled outwardly and downwardly by the rotating cone 56. Also as can be seen in FIG. 3, a first hollow ring 66 surrounds the rotatable hollow shaft 42 and the discharge outlet 54 above but adjacent the truncated cone 56. Binder material is coupled to the ring through hoses 32 and 78. The flow of asphalt through nozzle 72 can be controlled by an apparatus 74 driven by a pneumatic cylinder 76 which simultaneously opens or closes all of the nozzles 72 to allow or prevent asphalt from being sprayed therefrom. A second hollow ring 86 is mounted between the first asphalt spraying hollow ring 66 and the rotatable hollow shaft 42 in discharge outlet 54 which also has an inlet orifice 92 and a plurality of spaced nozzles 88 located about the periphery thereof. Thus water from nozzles 88 is sprayed as a mist on the swirling aggregate particles 64 from above and from nozzle 90 from the center of rotating hollow tube 42 from below thus entirely coating the particles 64 with water prior to being sprayed with the binder material from nozzles 72.

Figure 4:
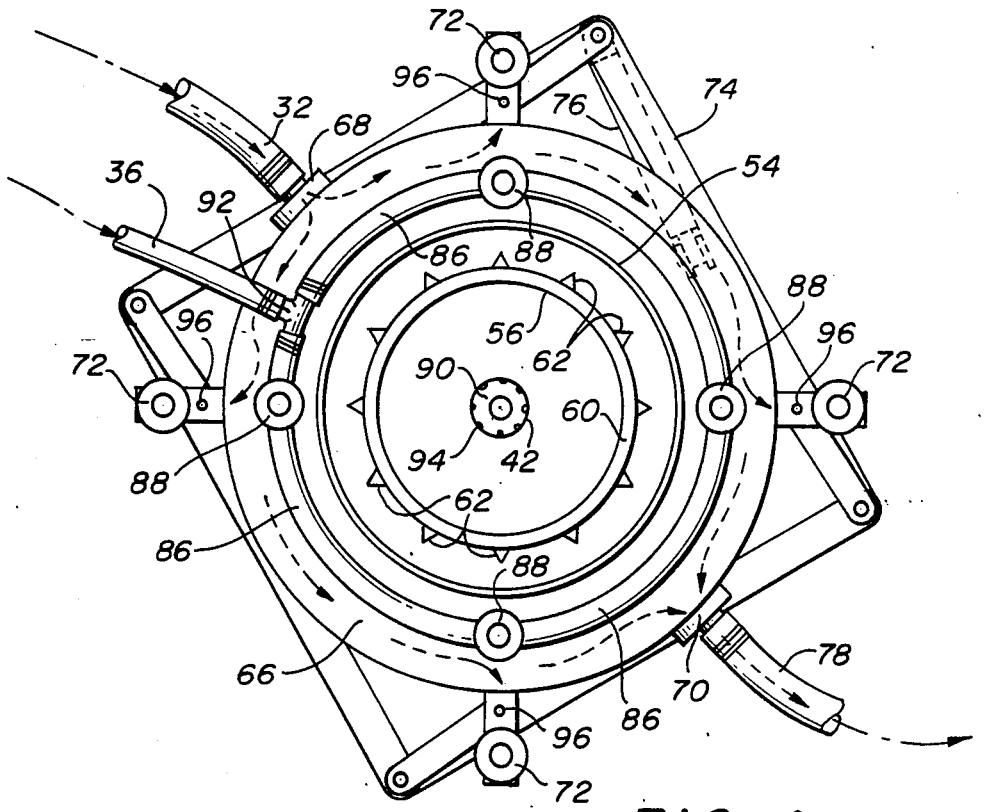
FIG. 4 is a bottom view of the aggregate discharge chute outlet surrounded by the water spraying ring and the asphalt spraying ring as well as illustrating the underside of the truncated cone having projections thereon which impart a swirling motion to the falling aggregate particles.

FIG. 4 is a bottom view of the aggregate discharge outlet 54 with hollow tube 42 rotatably mounted therein and having on the lower end thereof water spray nozzle 90 with a plurality of apertures 94 therein for spraying water upwardly on the swirling particles 64. The truncated cone 56 is shown from the bottom looking at the large end 60 and having a plurality of ribs or fingers 62 thereon which, when the cone 56 rotates, imparts the swirling motion to the particles 64 falling through discharge outlet 54.

It will be noted that immediately surrounding discharge outlet 54, and thus hollow rotating tube 42, is a circular ring 86 for carrying water therein and having a plurality of spaced nozzles 88 about the circumference thereof to spray water downwardly on the material 64 being ejected from discharge outlet 54. In addition, another hollow ring 66 is located on the outside of the water ring 86 and has asphalt introduced therein through hose 32. A plurality of spray nozzles 72 are attached to the circumference of ring 66 to spray asphalt on the aggregate material that has already been sprayed with the water mist. A frame 74 is coupled to a pneumatic actuated cylinder 76 which, when actuated, moves the frame 74 so as to simultaneously turn off valves 96 associated with each of the orifices 72 to be able to simultaneously open and close them as desired. Obviously any other manner of simultaneously opening and closing the valves 96 associated with nozzle 72 could also be used. The particular type shown in FIG. 4 is merely illustrative of one of the many types that could be used.

Thus there has been disclosed a novel movable or portable road repair and servicing vehicle which has the advantages disclosed in applicant's U.S. Pat. No. 4,511,284, in that it utilizes cold aggregate material to be coated with a quick setting binder material at the site where the repair or surfacing is to take place and yet is an improvement over the device in Pat. No. 4,511,284, in that it utilizes less power to impart the swirling motion to the aggregate material and which also utilizes an extra hopper for additive material, a rotating truncated cone with ribs or projections thereon to cause the aggregate material to have a swirling movement imparted to them, and means for spraying a water mist on top of and below the swirling aggregate material to cause it to have a greater affinity for the binder material which is sprayed thereon after the water is applied.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. In a movable road repair and surfacing vehicle of the type having a frame, an aggregate material hopper mounted on said frame, a container for binder material, conveyor means associated with said hopper for carrying said aggregate material, a discharge chute associated with said conveyor means for receiving said aggregate material carried thereon and directing said material downwardly, a discharge outlet on said chute for dispensing said aggregate material therefrom for deposit on a roadway surface, and means for spraying said binder material on said dispensed aggregate material, the improved apparatus for applying asphalt coated aggregate to the roadway surface comprising:

a. a hollow tube rotatably mounted within and extending below said outlet of said aggregate discharge chute, b. at least one projection mounted on the periphery of said hollow tube for premixing said aggregate material moving downwardly in said discharge chute, c. means attached to said hollow tube adjacent the bottom thereof for causing said aggregate material to swirl as it drops downwardly to said roadway surface from said discharge outlet, and d. means attached to said vehicle adjacent said discharge outlet for spraying said binder material on said swirling aggregate material after it leaves said discharge outlet but before it reaches said roadway surface.

2. An improved apparatus as in claim 1 further including:

a. water spraying means mounted adjacent said discharge outlet for spraying said swirling aggregate material from above with a water mist prior to being sprayed with said binder material to cause better adherence of said binder, b. a source of water coupled to said water spraying means and to the upper end of said rotating hollow tube, and c. a spray nozzle mounted on the lower end of said rotating hollow tube for spraying said swirling aggregate material from below to thoroughly wet said aggregate material with a water mist prior to being sprayed with said binder.

3. Improved apparatus as in claim 2 wherein said means for causing said aggregate material to swirl as it leaves said discharge outlet comprises:

a. a projection in the form of a truncated cone attached symmetrically about the outer periphery of said rotating hollow tube adjacent to but above the lower end of said rotating tube with the large flared end of said cone facing downwardly and flaring outwardly with the lower end of said hollow tube extending below the large flared end of said cone, and b. at least one raised projection on the outer surface of said truncated cone for causing a swirling movement of said aggregate particles.

4. Improved apparatus as in claim 3 wherein said projections on said truncated cone are elongated fingers, rectangular in cross-section and equally spaced about and extending downwardly and outwardly on the outer surface of said cone from the small end to the flared end.

5. Improved apparatus as in claim 4 wherein said means for spraying said binder material comprises:

a. a hollow circular ring surrounding said rotatable hollow tube and mounted above but adjacent said truncated cone, b. an input and an output orifice in said hollow ring, c. a plurality of spray nozzles extending substantially downwardly from said ring about the circumference thereof, and d. means coupling said binder material from said binder container through said input orifice to the interior of said hollow circular ring under pressure whereby said binder material spraying from said nozzles encounters and coats said swirling aggregate material as it swirls and drops downwardly to said roadway surface.

6. Improved apparatus as in claim 5 further comprising:

a. means for providing each of said spray nozzles with an OFF position to prevent spraying and an ON position for allowing spraying, and b. means coupled to each of said spray nozzles for simultaneously turning said nozzles to the ON and OFF positions.

7. Improved apparatus as in claim 7 further including:

a. first and second orifices in said binder tank, b. a first hose coupling said first orifice to said input orifice in said hollow circular ring to provide binder to the interior thereof, c. a second hose coupling said output orifice in said ring to said second orifice in said binder tank to allow binder to circulate through said hollow ring, and d. a shut-off valve in said second hose to prevent said binder from returning to said tank during spraying operations thereby forcing said binder out of said spray nozzles under pressure.

8. Improved apparatus as in claim 7 wherein said water spraying means further comprises:

a. a second hollow circular ring mounted vehicle between said first binder spraying hollow ring and said rotatable hollow tube, b. an inlet orifice in said second ring and a plurality of spaced nozzles located about the periphery thereof, and c. means coupling said water source to said second ring inlet orifice whereby a water mist is sprayed from said spaced nozzles onto said swirling aggregate material prior to being sprayed with said binder material.

9. Improved apparatus as in claim 8 further comprising:

a. a second hopper mounted above said conveyor means between said aggregate material hopper and said discharge chute for containing agents to be added to said aggregate material, and b. means in said second hopper for causing said agents to be selectively added to said aggregate material prior to entering said discharge chute.

10. In a method of repairing and surfacing a road including the steps of mounting an aggregate material hopper on a movable vehicle frame, providing a binder material container on said vehicle, associating a conveyor means with said hopper for carrying said aggregate material, associating a discharge chute with said conveyor means for receiving said aggregate material carried thereon and directing said material downwardly, and dispensing said aggregate material from a discharge outlet on said chute for deposit on a roadway surface, the improvement comprising the steps of:

a. rotatably mounting a hollow tube within and extending below said outlet of said discharge chute, b. mounting at least one projection on the periphery of said hollow tube for premixing said aggregate material moving downwardly in said discharge chute, c. attaching means to said hollow tube adjacent the bottom thereof for causing said aggregate material to swirl as it drops downwardly to said roadway surface from said discharge outlet, and d. spraying said binder material on said dispensed aggregate material after it leaves said discharge outlet but before it reaches said roadway surface.

11. The improved method of claim 10 further including the steps of:

a. mounting water spraying means adjacent said discharge outlet for spraying said swirling aggregate material from above with a water mist prior to being sprayed with said binder material to cause better adherence of said binder, b. coupling a source of water to said water spraying means and to the upper end of said rotating hollow tube, and c. mounting a spray nozzle on the lower end of said rotating hollow tube for spraying said swirling aggregate material from below to throughly wet said aggregate material with a water mist prior to being sprayed with said binder.

12. The method of claim 11 wherein the step of causing said aggregate material to swirl as it leaves said discharge outlet further comprises the steps of:

a. attaching a projection in the form of a truncated cone symmetrically about the outer periphery of said rotating hollow tube adjacent to but above the lower end of said rotating tube with the large flared end of said cone facing downwardly and flaring outwardly with the lower end of said hollow tube extending below said large flared end of said cone, and b. forming at least one raised projection on the outer surface of said truncated cone for causing a swirling movement of said aggregate particles.

13. The improved method of claim 12 further including the step of forming said projections on said truncated cone of elongated fingers, rectangular in cross-section and equally spaced about and extending downwardly and outwardly on the outer surface of said cone from the small end to the flared end.

14. The improved method of claim 13 wherein the step of spraying said binder further comprises the steps of:

a. surrounding said rotatable hollow tube with a hollow circular ring above but adjacent said truncated cone, b. forming an input and an output orifice in said hollow ring, c. extending a plurality of spray nozzles substantially downwardly from said ring about the circumference thereof, and d. coupling said binder material from said binder container through said input orifice to the interior of said hollow circular ring under pressure whereby said binder spraying from said nozzles encounters and coats said swirling aggregate material as it swirls and drops downwardly to said roadway surface.

15. The improved method of claim 14 further comprising the steps of:

a. providing each of said spray nozzles with an OFF position to prevent spraying and an ON position for allowing spraying, and b. coupling means to each of said spray nozzles for simultaneously turning said nozzles to the ON and OFF positions.

16. An improved method as in claim 15 further comprising the steps of:

a. forming first and second orifices in said binder tank, b. coupling a first hose between said first orifice and said input orifice in said hollow circular ring to provide binder to the interior thereof, c. coupling a second hose between said output orifice in said ring and said second orifice in said binder tank to allow binder to circulate through said hollow ring, and d. providing a shut-off valve in the second hose to prevent said binder from returning to said tank during spraying operations thereby forcing said binder out of said spray nozzles under pressure.

17. An improved method as in claim 16 wherein the step of mounting said water spraying means further comprises the steps of:

a. mounting a second hollow circular ring on said vehicle between said first binder spraying hollow ring and said rotatable hollow tube, b. providing an inlet orifice in said second ring and a plurality of spaced nozzles about the periphery thereof, and c. coupling said water source to said second ring inlet orifice whereby a water mist is sprayed from said spaced nozzles onto said swirling aggregate material prior to being sprayed with said binder material.

18. An improved method as in claim 17 further comprising the steps of:

a. mounting a second hopper above said conveyor means between said aggregate material hopper and said discharge chute for containing agents to be added to said aggregate material, and b. causing said agents to be selectively added to said aggregate material prior to entering said discharge chute.

* * * * *

UNITED STATES PATENT AND TRADEMARK OFFICE

CERTIFICATE OF CORRECTION

PATENT NO. : 4,678,363

DATED : July 7, 1987

INVENTOR(S) : Carl L. Sterner

It is certified that error appears in the above-identified patent and that said Letters Patent are hereby corrected as shown below:

IN THE CLAIMS:

Column 8, line 63, after the term "mounted" and before the term "vehicle" insert -- on said--.

Signed and Sealed this

Third Day of November, 1987

*Attest:*

DONALD J. QUIGG

*Attesting Officer*

*Commissioner of Patents and Trademarks*